United States Patent [19]

Kornelson

[11] Patent Number: 4,924,363

[45] Date of Patent: May 8, 1990

[54] ATTENTION-ATTRACTING DEVICE FOR USE BENEATH A DISPLAY SHELF

[75] Inventor: Bradley F. Kornelson, Saanichton, Canada

[73] Assignee: Dapopp Products Ltd., Saanichton, Canada

[21] Appl. No.: 311,186

[22] Filed: Feb. 15, 1989

[51] Int. Cl.[5] ..... A47F 11/10

[52] U.S. Cl. ..... 362/125; 40/442; 40/553; 40/642; 362/184; 362/191; 362/234; 362/252; 362/398; 362/800; 362/812

[58] Field of Search ..... 40/442, 553, 642; 362/125, 133, 184, 191, 234, 252, 398, 800, 806, 812, 811

[56] References Cited

U.S. PATENT DOCUMENTS 1,844,692 2/1932 Schnoor ..... 40/533 X
2,223,685 12/1940 Herberger ..... 40/442

*Primary Examiner*—Stephen F. Husar
*Attorney, Agent, or Firm*—Christie, Parker & Hale

[57] ABSTRACT

An attention-attracting device for use e.g. beneath a supermarket shelf has light-emitting diodes at the front of the device for presenting a visually noticeable signal to persons in the vicinity of the device, the light-emitting diodes being intermittently energized to cause the signal to be flashing signal.

9 Claims, 2 Drawing Sheets

ATTENTION-ATTRACTING DEVICE FOR USE BENEATH A DISPLAY SHELF

FIELD OF THE INVENTION

The present invention relates to an attention-attracting device for use in association with a display shelf, and is useful in particular, but not exclusively, as a price-ticket holder and display device for use beneath a supermarket shelf.

BACKGROUND OF THE INVENTION

Conventional supermarket shelves have front edges which are shaped to releasably retain price tickets at the front edges of the shelves, so that passers by can be informed of the names, weights, prices, etc. of commodities displayed for sale on the shelves.

It is, of course, well known to employ an illuminated display of one kind or another, and in particular an intermittently flashing illuminated display, for the purpose of attracting the attention of persons in the vicinity, and many flashing advertising and display devices of various types have previously been employed for this purpose.

However, there exists a need for improved means for attracting the attention of passers-by to items displayed on shelves in supermarkets, in which the shelves are often long and numerous and crowded with numerous items of different colors, designs and shapes on display for sale on the shelves. In such an environment, a conventional price ticket does not attract particular attention to its associated item, particularly from a distance. An effective device is therefore desirable for specifically drawing attention to a particular item among a multitude of items on display in a supermarket.

A BRIEF SUMMARY OF THE INVENTION

It is accordingly an object of the present invention to provide a novel and improved device for use in association with a display shelf for attracting the attention of passers by.

It is a further object of the present invention to provide an attention-attracting device which can be secured to the under-side of a display shelf and which emits a flashing, attention-grabbing visual signal.

According to the present invention, there is provided an attention-attracting device for use in association with a display shelf which comprises light-emitting means at the front of the device for presenting a visually noticeable signal to persons in the vicinity of the device, and means for intermittently energising the light-emitting means to cause the signal to be a flashing signal. The device further includes means for securing the light-emitting means in a location beneath the display shelf.

With this device in use, for example beneath the front of a supermarket shelf, the flashing signal can be employed to attract the attention of shoppers, from a considerable distance from the device, to the device itself and to a display item on the shelf with which the device is associated.

In a preferred embodiment of the invention, the light-emitting means form an illuminated shape in the form a vertically-directed arrow head. The light-emitting means can be selectively supported in oppositely vertically directed positions, to enable the arrow head to be directed towards an item on an over-lying shelf or an underlying shelf.

The light-emitting means are provided in a forwardly-projecting portion of the device so as to be visible not only from the front of the device but also from the sides of the device, for example through windows in the sides of the forwardly projecting portion.

The device also be provided with means for releasably retaining a display ticket, for example a price ticket, at the front of the device.

BRIEF DESCRIPTION OF THE DRAWING

Further feature, objects, and advantages of the present invention will appear from time to time in the following description of the present invention when taken in conjunction with the accompanying drawings, in which.

THE PREFERRED EMBODIMENT

Figure 1:
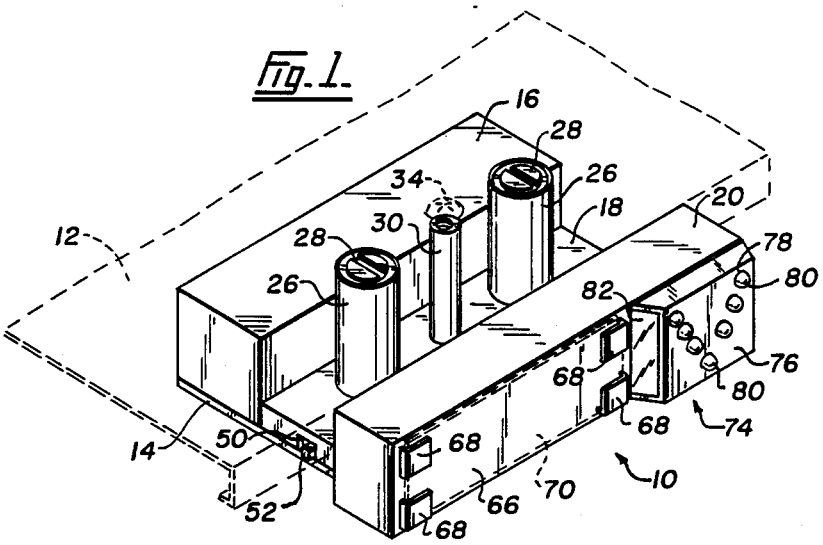
FIG. 1 shows a view in perspective of an attention-attracting device according to the present invention located beneath a shelf.
Figure 2:
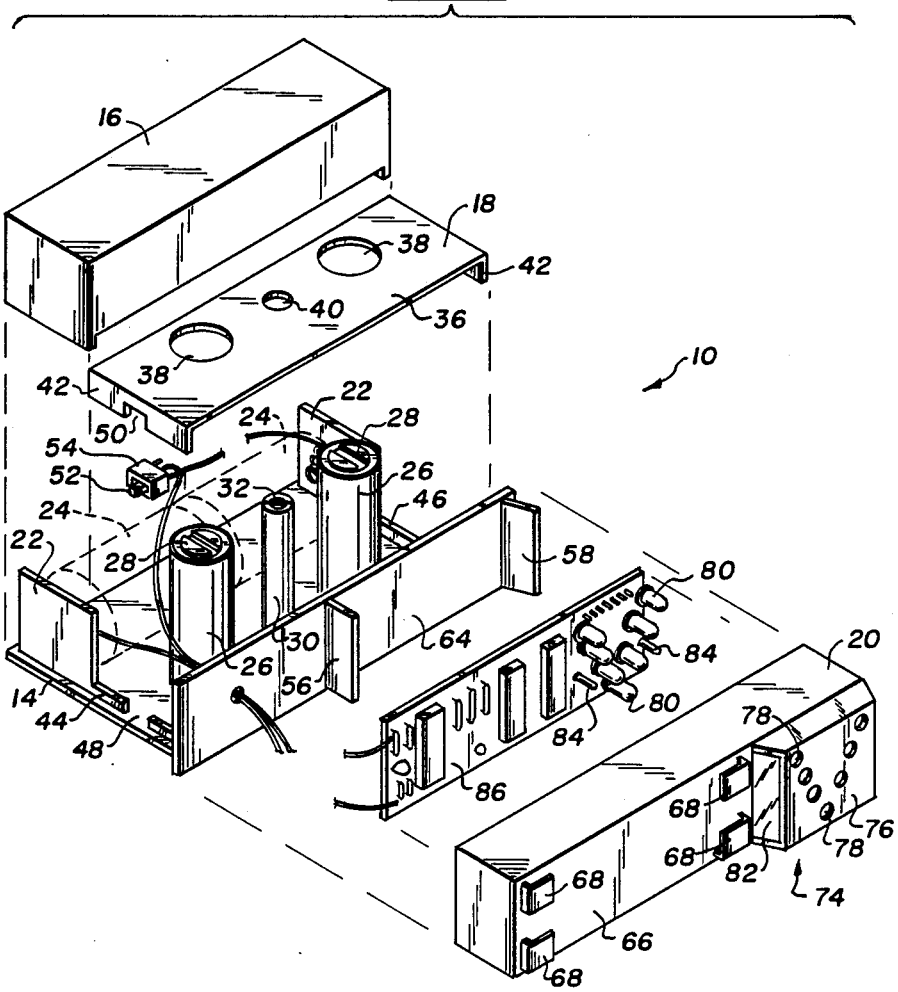
FIG. 2 shows an exploded view, in perspective, of the device of FIG. 1.

As shown in FIG. 1, an attention-attracting device according to the invention, which is indicated generally by reference numeral 10, is secured to the under-side of a supermarket shelf, which is shown in broken lines and indicated by reference numeral 12.

The device 10 has a housing which comprises a base portion 14 and three covers 16, 18 and 20.

The base portion 14 is provided with a pair of upstanding side walls 22, which are spaced apart at opposite sides of the base portion 14 and which are generally square in shape, and a pair of power cells 24 are accommodated between the side walls 22.

The cover 16 is rectangular in plan view and elevation and is downwardly open, and the side walls 22 are shaped and dimentioned so as to fit snugly into the interior of the cover 16, at opposite ends of the cover 16, for releasably retaining the cover 16 on the base portion 14 at the rear of the base portion 14 and over the power cells 24.

Forward of the cover 16, the base portion 14 is formed with a pair laterally-spaced, upstanding cylindrical projections 26. Magnets 28 mounted in the tops of these cylindrical projections 26 are provided for temporarily securing the device 10 to the underside of the shelf 12, which is made of steel. A third upstanding cylindrical projection 30 on the base portion 14 is located between the projections 26, and is formed with a screw-threaded hole 32 extending downwardly from the top of the projection 30. By means of a bolt 34, inserted downwardly through a bolt hole (not shown) in the shelf 12 and into threaded engagement with the hole 32 in the projection 30, the device 10 can be permanently and securely retained at the underside of the front of the shelf 12. To counteract vandalism or theft of the device 10, the bolt 34 is preferably of a type bearing a special vandal-resistant head which requires a special tool for tightening and releasing the bolt 34.

The cover 18 has a flat, horizontal rectangular portion 36 formed with circular openings 38 and 40 for receiving the projections 26 and 30. The cover 18 also has depending side walls 42 which fit with a snap-action over upstanding side walls 44 and 46 on the base portion 14 for releasably securing a cover 18 to the base portion 14.

The side wall 44 on the base portion 14 is formed with a cut-out 48, and the corresponding side wall 42 of the cover 18 is formed with a corresponding cut-out 50, for accommodating the actuating lever 52 of a switch 54, by means of which the device can be switched on and off.

The cover 20, which is a front cover, is rectangular in plan view and is open at its rear side to snugly receive and engage with forwardly extending projections 56 and 58 which are provided on the front side of an upstanding rectangular front wall 64 of the base portion 14. In this way the front cover 20 is releasably secured to the base portion 14, with the base portion front wall 64 received in the rear opening of the front cover 20.

The front cover 20 has a front face 66, on which four ticket retainer lugs 68 are provided for releasably retaining a display ticket 70, which normally would be in the form of a conventional super market shelf price ticket.

The front cover front face 66 extends at one end thereof to a front projection, which extends forwardly from the plane of the front face 66 and which is indicated generally by reference numeral 74.

The front projection 74 has a flat, rectangular front face 76, which is interrupted by plurality of openings 78 arranged in a vertically directed Vee or arrowhead-shaped array. When the device is assembled as shown in FIG. 1, a plurality of light emitting diodes 80 project forwardly through these opening 78.

The front projection 74 is also formed, at each of its opposite sides, with a transparent window 82, only one of which is shown and through which light emitted by the light emitting diodes 80 escapes laterally from the front projection 74 so as to be readily visible to persons located at opposite sides of the device 10.

Figure 3:
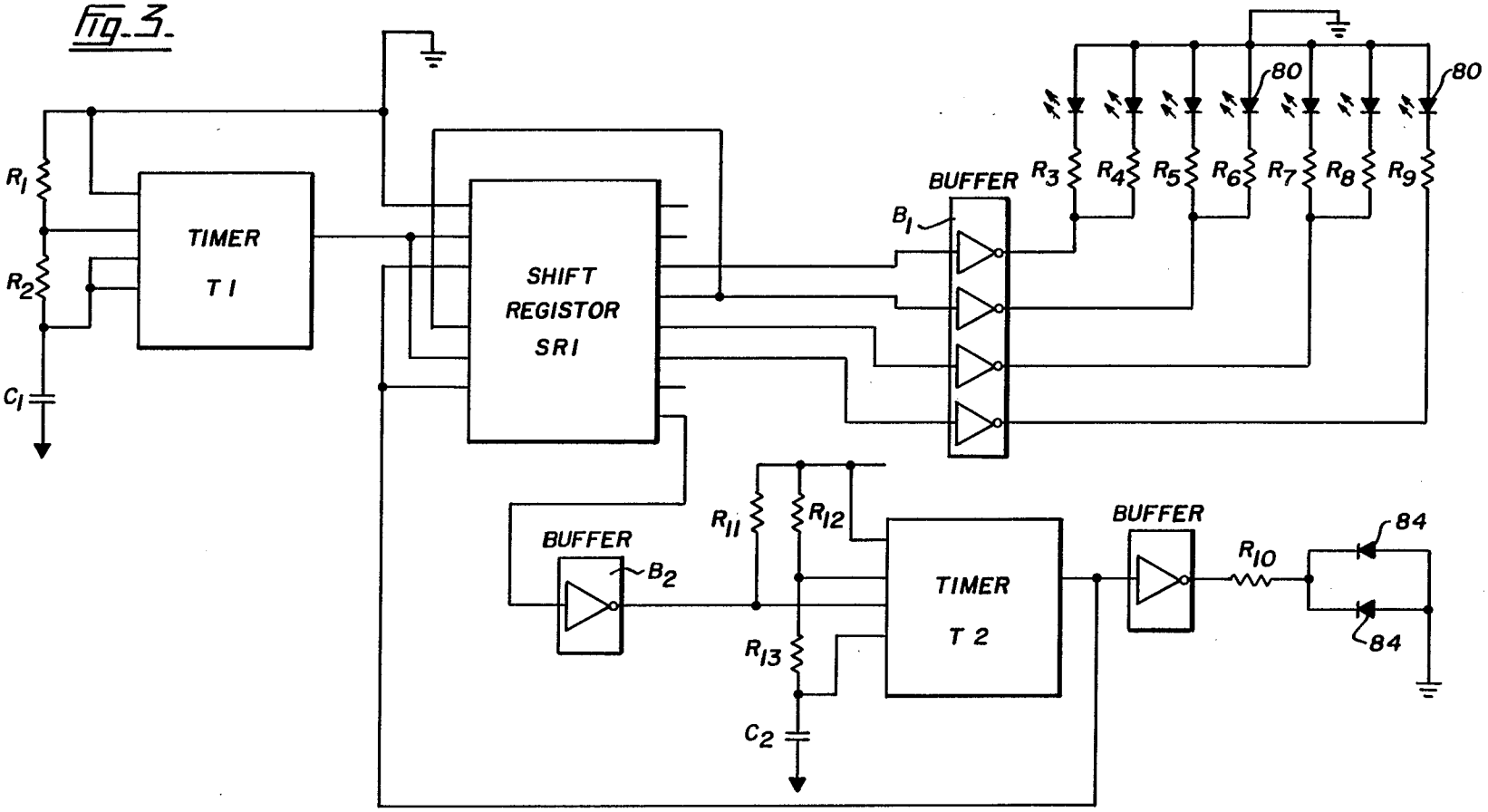
FIG. 3 shows a circuit diagram of the electrical circuitry of the device of FIGS. 1 and 2.

Between the front cover 20 and the base portion front wall 64, there is provided a circuit board 86, on which the light-emitting diodes 80 are provided and on which the additional circuit components, illustrated in FIG. 3 are also mounted.

As shown in FIG. 3, the electrical control circuit of the device comprises a first timer T1, whose input pins are connected to a pair of resistors R1 and R2 and a capacitor C1, the values of which determine the frequency of the output of the timer T1.

A shift register SR1, connected to the output of the timer T1, provides output signals sequentially to the inputs of a buffer B1, the outputs of which are connected through resistors R3–R9 to the light emitting diode 80. As can be seen from FIG. 3, the resistors R3–R8 are connected in pairs to the outputs of the buffers B1, so that each pair will be simultaneously energized, whereas the resistor R9, which is connected to the light emitting diode 80 located at the tip of the arrowhead array of the light-emitting diodes, is the only resistor connected to the respective output of buffer B1. Consequently, in operation of the device, the tip of the arrowhead array is firstly illuminated, and then the illuminator travels up the two sides of the array.

The shift register SR1 also outputs through a buffer B2 to a timer T2, the output of which, through a buffer B3, and a resistor R10 intermittently energizes a further pair of light emitting diodes 84, which are respectively associated with the windows 82 for emitting light laterally from the front projecting portion 74 of the device. Through a feed back conductor 86 from the time T2 to the shift register SK1, the latter is reset. The frequency of the timer T2 is determined by resistors R11, R12 and R13 and a capacitor C2.

As will be apparent to those skilled in the art, various modifications may be made in the above device within the scope of the following claims.

We claim:

1. An attention-attracting device for use in association with a display shelf, comprising;

light-emitting means at the front of said device for presenting a visually noticeable signal to persons in the vicinity of said device;

means for intermittently energizing said light-emitting means to cause said signal to be a flashing signal; and means for securing said light-emitting means in a location beneath the display shelf.

2. An attention-attracting devices as claimed in claim 1, wherein said light-emitting means comprise means for forming an illuminated shape in the form of a vertically-directed arrowhead.

3. An attention-attracting device as claimed in claim 2, further comprising means for selectively supporting said light-emitting means in oppositely vertically directed positions.

4. An attention-attracting device as claimed in claim 2, wherein said means for forming an illuminated array comprise a plurality of light sources arranged in an array having the shape of the arrowhead and said energizing means comprise means for sequentially illuminating said light sources.

5. An attention-attracting device as claimed in claim 1, further comprising a projecting front portion, said light-emitting means including means for emitting light forwardly and laterally from said front portion.

6. An attention-attracting device as claimed in claim 1, further comprising means for releasably retaining a display ticket at the front of said device.

7. An attention-attracting device as claimed in claim 1, further comprising magnetic means for temporarily holding said device in a location at the underside of the shelf, and screw-threaded means for securely retaining said device in said location.

8. An attention-attracting device for location at the underside of the front of a display shelf, said device comprising light-emitting means at the front of said device for presenting a visually noticeable illuminated attention-attracting display to persons in the vicinity;

means for intermittently energizing said light-emitting means to thereby cause said display to appear in a flashing fashion;

means for retaining an information display ticket on the front of said device; and means for securing said device in said location at the underside of the display shelf.

9. An attention-attracting device as claimed in claim 8, wherein said energizing means include power cells in said device.

* * * * *